US008083320B2

(12) United States Patent
Yoshida et al.

(10) Patent No.: US 8,083,320 B2
(45) Date of Patent: Dec. 27, 2011

(54) LIQUID EJECTING APPARATUS AND IMAGE FORMING METHOD

(75) Inventors: Masahiko Yoshida, Shiojiri (JP); Takeshi Yoshida, Shiojiri (JP); Michiaki Tokunaga, Matsumoto (JP); Tatsuya Nakano, Hata-machi (JP)

(73) Assignee: Seiko Epson Corporation, Tokyo (JP)

( * ) Notice: Subject to any disclaimer, the term of this patent is extended or adjusted under 35 U.S.C. 154(b) by 639 days.

(21) Appl. No.: 12/284,300

(22) Filed: Sep. 18, 2008

(65) Prior Publication Data

US 2009/0115805 A1 May 7, 2009

(30) Foreign Application Priority Data

Sep. 18, 2007 (JP) ..... 2007-241369
Jun. 26, 2008 (JP) ..... 2008-167709

(51) Int. Cl.
*B41J 29/38* (2006.01)
*B41J 2/155* (2006.01)

(52) U.S. Cl. ..... 347/42; 347/5; 347/9; 347/12; 347/13; 347/40; 347/41; 347/54

(58) Field of Classification Search ..... 347/12, 347/13, 41, 42
See application file for complete search history.

(56) References Cited

U.S. PATENT DOCUMENTS

| | | | | |
|---|---|---|---|---|
| 6,390,598 | B2 * | 5/2002 | Sato et al. | 347/41 |
| 6,443,554 | B1 * | 9/2002 | Yoshida | 347/41 |
| 7,441,858 | B2 * | 10/2008 | Hoshiyama et al. | 347/16 |
| 7,641,308 | B2 * | 1/2010 | Mitsuzawa | 347/41 |
| 2002/0018099 | A1 * | 2/2002 | Fujioka | 347/43 |

FOREIGN PATENT DOCUMENTS

WO WO-01/03930 A1 1/2001

* cited by examiner

*Primary Examiner* — Ryan Lepisto
(74) *Attorney, Agent, or Firm* — Nutter McClennen & Fish LLP; John J. Penny, Jr.; Christina M. Sperry

(57) ABSTRACT

Liquid ejecting apparatuses and image formed methods are provided. In an exemplary embodiment, a liquid ejecting apparatus is provided including a head unit, a movement mechanism, and a control section. The head unit has along a first direction a plurality of heads, in which a plurality of nozzles that eject a liquid onto a medium are lined up in the first direction, and the head unit forms a single raster line by ejecting the liquid while performing m number of movements relative to the medium in a second direction, which intersects the first direction. The movement mechanism causes the head unit to perform a plurality of movements relative to the medium alternately in the second direction and the first direction. The control section forms an image having a resolution that is n times a pitch of the nozzles.

3 Claims, 11 Drawing Sheets

LIQUID EJECTING APPARATUS AND IMAGE FORMING METHOD

CROSS-REFERENCE TO RELATED APPLICATIONS

The present application claims priority upon Japanese Patent Application No. 2007-241369 filed on Sep. 18, 2007, and Japanese Patent Application No. 2008-167709 filed on Jun. 26, 2008, which are herein incorporated by reference.

BACKGROUND

1. Technical Field

The present invention relates to liquid ejecting apparatuses and image forming methods.

2. Related Art

As one example of liquid ejecting apparatuses, there are known Inkjet printers that carry out printing by ejecting liquid (ink) onto a medium such as paper, cloth, and film. These printers are provided with a head in which a plurality of nozzles for ejecting liquid onto a medium are lined up in a first direction (sub-scanning direction), and this head ejects the liquid while moving in a second direction (main scanning direction) that intersects the first direction.

From a viewpoint of increasing picture quality, the above-mentioned printer may for example carry out so-called overlap printing or interlaced printing. That is, the printer moves the head a plurality of times alternately in the second direction and the first direction, and forms a plurality of raster lines, to form an image (see International Publication WO 01/03930).

In this regard, from a viewpoint of increasing the speed of printing, some of these printers are provided with a head unit that has a plurality of the heads arranged along the first direction. In this case, it is conceivable for example that a width of the head unit in the first direction is set wider than a width of the medium in the first direction in such a manner as liquid is ejected at one time across an entire width region of the medium. However, with this configuration, in the case where the total movement amount of the head unit in the first direction during printing is large, it is necessary to increase the first direction width of the head unit in order to eject the liquid at one time across the entire width region of the medium during movement in the second direction.

Furthermore, it is known that ejection characteristics of liquids vary due to individual differences of the heads. For example, one head may have a characteristic of ejecting liquid easily, while another head may have a characteristic of ejecting liquid with difficulty. For this reason, in the case where the plurality of heads that constitute the head unit are to eject liquid, so-called density irregularities or the like may occur due to differences in the ejection characteristics of each of the heads, and as a result, there is a risk that image quality will deteriorate.

SUMMARY

The invention was arrived at in light of these issues and it is an advantage thereof to suppress deterioration in image quality and to suppress increases in the width of the head unit in the first direction.

A primary aspect of the invention is a liquid ejecting apparatus such as the following.

A liquid ejecting apparatus including:

a head unit that has along a first direction a plurality of heads, in which a plurality of nozzles that eject a liquid onto a medium are lined up in the first direction, and that forms a single raster line by ejecting the liquid while performing m number of movements relative to the medium in a second direction, the second direction intersecting the first direction, a width of the head unit in the first direction being greater than a width of the medium in the first direction;

a movement mechanism that causes the head unit to perform a plurality of movements relative to the medium alternately in the second direction and the first direction; and a control section that forms an image having a resolution that is n times a pitch of the nozzles, by forming a plurality of the raster lines by the plurality of relative movements of the head unit, and that forms the image by setting a total movement amount of the head unit in the first direction when the head unit performs the plurality of relative movements, larger than an effective nozzle width of one of the heads in the first direction multiplied by (m×n−1), and smaller than the effective nozzle width×(m×n), and by setting respective movement amounts of the head unit in the first direction when the head unit performs the plurality of relative movements, larger than the effective nozzle width.

Other features of the invention will be made clear by reading the description of the present specification with reference to the accompanying drawings.

DESCRIPTION OF EXEMPLARY EMBODIMENTS

Figure 1:
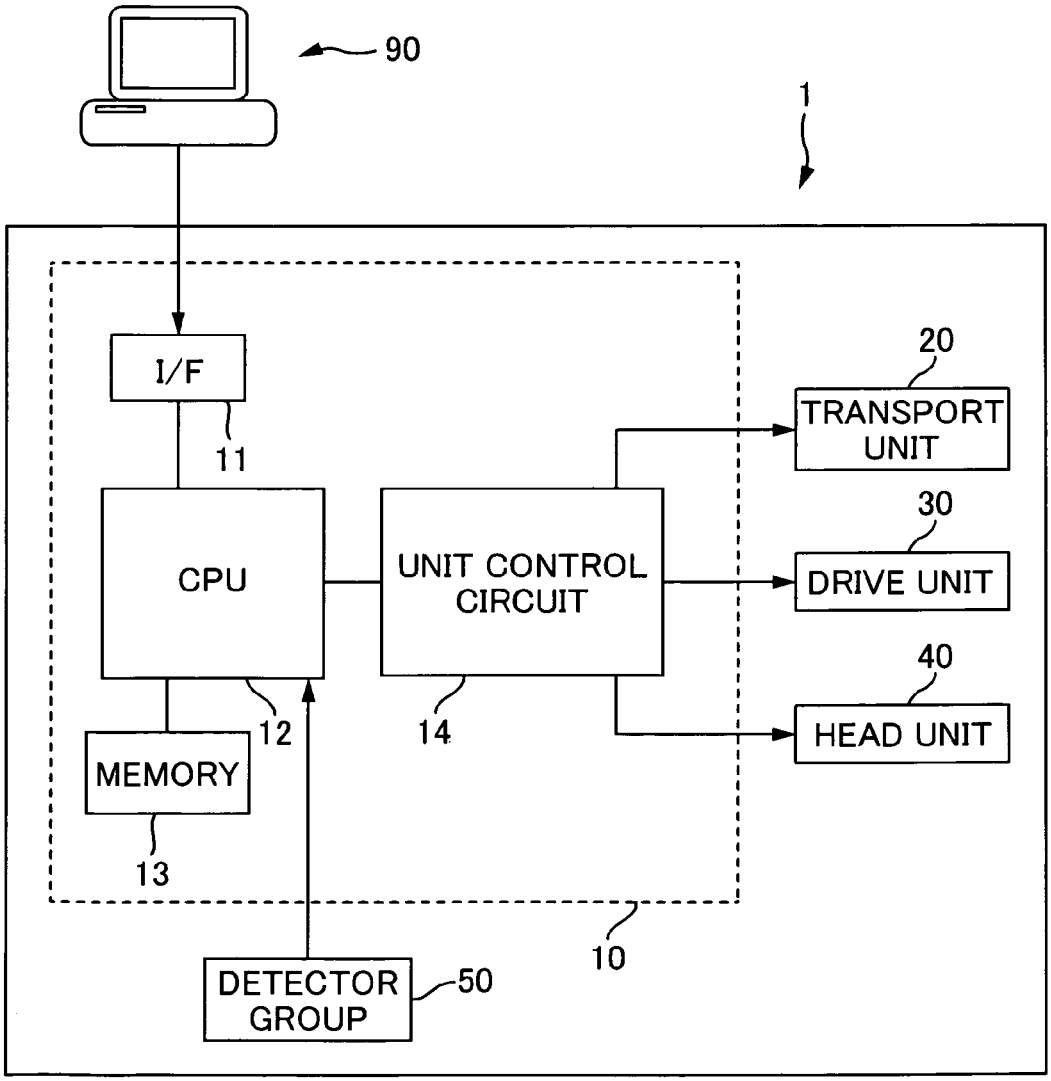
FIG. 1 is a block diagram of an overall configuration of a printer 1.

At least the following matters will be made clear by reading the description of the present specification with reference to the accompanying drawings.

A liquid ejecting apparatus including:

a head unit that has along a first direction a plurality of heads, in which a plurality of nozzles that eject a liquid onto a medium are lined up in the first direction, and that forms a single raster line by ejecting the liquid while performing m number of movements relative to the medium in a second direction, the second direction intersecting the first direction, a width of the head unit in the first direction being greater than a width of the medium in the first direction;

a movement mechanism that causes the head unit to perform a plurality of movements relative to the medium alternately in the second direction and the first direction; and a control section that forms an image having a resolution that is n times a pitch of the nozzles, by forming a plurality of the raster lines by the plurality of relative movements of the head unit, and that forms the image by setting a total movement amount of the head unit in the first direction when the head unit performs the plurality of relative movements, larger than an effective nozzle width of one of the heads in the first direction multiplied by (m×n−1), and smaller than the effective nozzle width×(m×n), and by setting respective movement amounts of the head unit in the first direction when the head unit performs the plurality of relative movements, larger than the effective nozzle width.

With this liquid ejecting apparatus, it is possible to suppress deterioration in image quality and to suppress increases in the width of the head unit in the first direction.

Also in such a liquid ejecting apparatus, it is desirable that n is 2 or any larger natural number, and the control section forms n number of successive raster lines by causing the nozzles of (m×n) number of the heads to eject the liquid.

In this case, deterioration in image quality can be effectively suppressed.

Also in such a liquid ejecting apparatus, it is desirable that the respective movement amounts of the head unit in the first direction when the head unit performs the plurality of relative movements, are equal.

In this case, deterioration in image quality can be more effectively suppressed.

An image forming method including:

preparing a head unit that has along a first direction a plurality of heads, in which a plurality of nozzles that eject a liquid onto a medium are lined up in the first direction, and that forms a single raster line by ejecting the liquid while performing m number of movements relative to the medium in a second direction, the second direction intersecting the first direction, a width of the head unit in the first direction being greater than a width of the medium in the first direction; and forming an image having a resolution that is n times a pitch of the nozzles, by forming a plurality of the raster lines by causing the head unit to perform a plurality of movements relative to the medium alternately in the second direction and the first direction, by setting a total movement amount of the head unit in the first direction when the head unit performs the plurality of relative movements, larger than an effective nozzle width of one of the heads in the first direction multiplied by (m×n−1), and smaller than the effective nozzle width×(m×n), and by setting respective movement amounts of the head unit in the first direction when the head unit performs the plurality of relative movements, larger than the effective nozzle width.

With this image forming method, it is possible to suppress deterioration in image quality and to suppress increases in the width of the head unit in the first direction.

Example Configuration of Inkjet Printer

An inkjet printer (hereinafter referred to as "printer 1") serving as one example of a liquid ejecting apparatus uses an inkjet system to print unit images that are later to be cut off and used, onto a band-shaped printing tape T serving as one example of a medium; the unit image being, for example, a sticker type printed item to be attached onto a wrapping film for fresh foods. Here, the printing tape T is a rolled paper (continuous paper) having a sticker release paper, and the images that are to become printed items are printed continuously in a direction in which the printing tape T is continuous.

Configuration of Printer 1

Figure 2A:
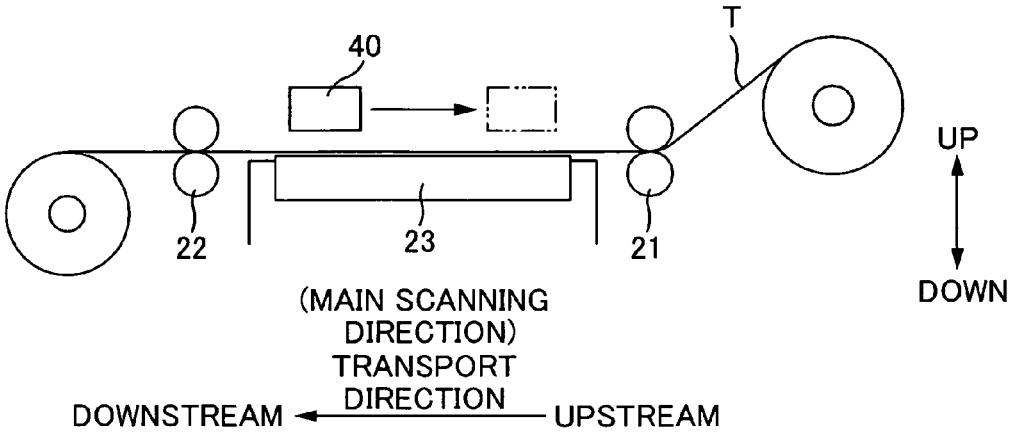
FIG. 2A is an outline cross-sectional view of the printer 1.
Figure 2B:
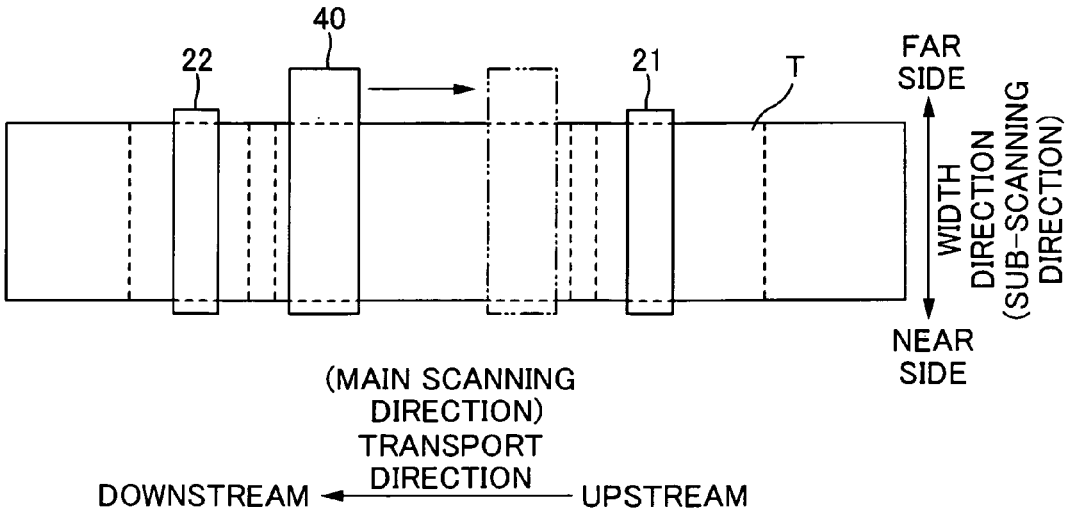
FIG. 2B is an outline top view of the printer 1.
Figure 3:
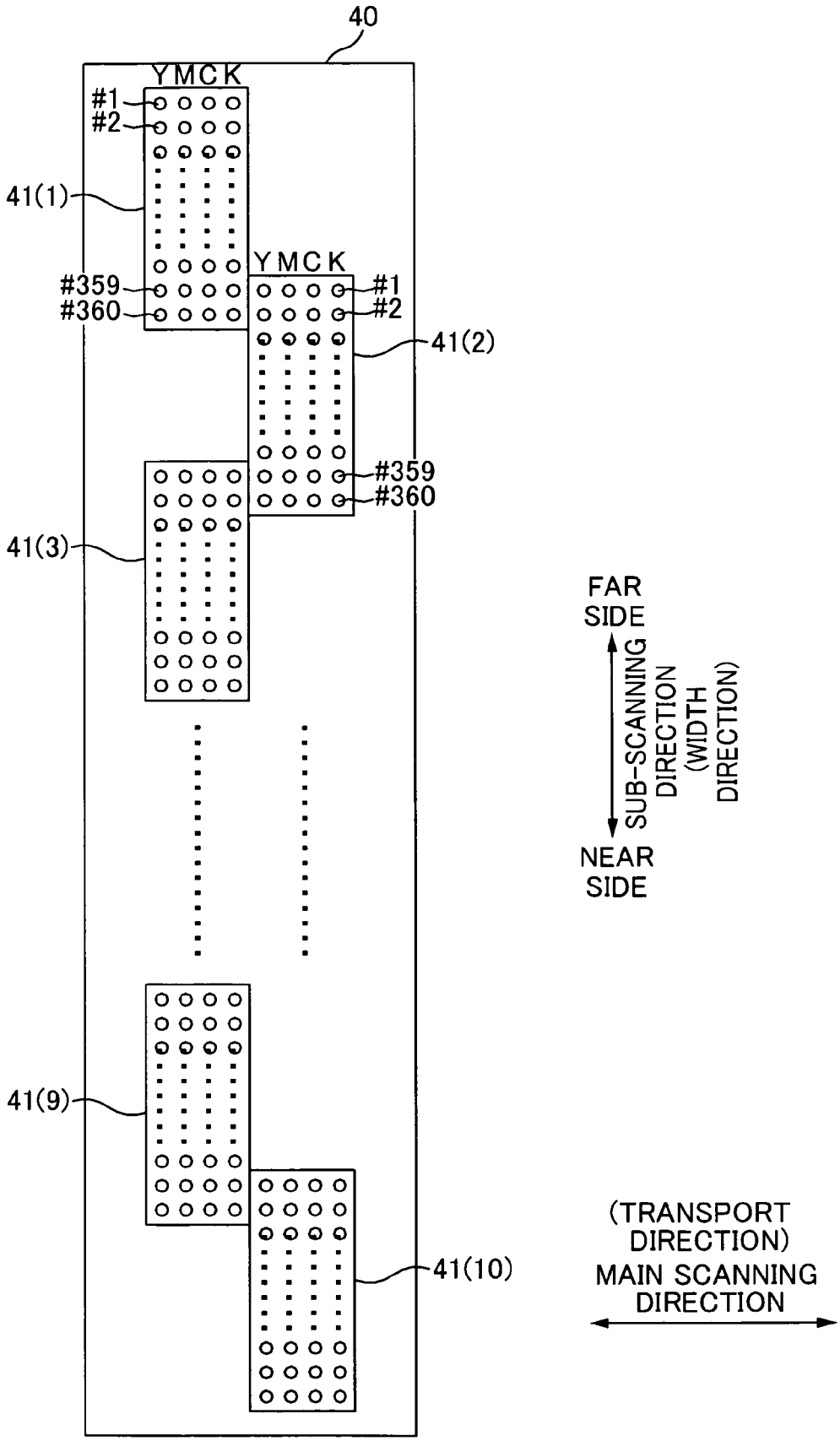
FIG. 3 shows a nozzle arrangement on a lower face of a head unit 40.

FIG. 1 is a block diagram of an overall configuration of the printer 1. FIG. 2A is an outline cross-sectional view of the printer 1, and FIG. 2B is an outline top view of the printer 1. FIG. 3 shows a nozzle arrangement on a lower face of a head unit 40.

Upon receiving print data, the printer 1 controls each unit (a transport unit 20, a drive unit 30, and the head unit 40) using a controller 10, which is one example of a control section, and forms an image on the printing tape T. It should be noted that conditions within the printer 1 are monitored by a detector group 50, and the controller 10 controls each unit based on detection results thereof.

The transport unit 20 is for transporting the printing tape T in a direction in which the printing tape T is continuous (hereinafter referred to as transport direction) from an upstream side to a downstream side. The transport unit 20 is provided with components such as feed rollers 21, feed out rollers 22, and a sucking table 23. The feed rollers 21 feed the printing tape T, which is in a roll form before printing, onto the sucking table 23, which is a printing region. The sucking table 23 holds the printing tape T by performing vacuum suction on the printing tape T from below. The feed out rollers 22 feed out from the printing region the printing tape T that has been printed. The printing tape T that has been fed out from the printing region is wound into a roll form by a winding mechanism.

The drive unit 30 is a movement mechanism that causes the head unit 40 to move readily in a main scanning direction, which corresponds to the transport direction, and a sub-scanning direction, which corresponds to a width direction of the printing tape T. The drive unit 30 is constituted for example by an X movement table, which causes the head unit 40 to move in the main scanning direction, and a Y movement table, which causes the X movement table holding the head unit 40 to move in the sub-scanning direction, and a motor that causes these to move (not shown).

The head unit 40 forms dot rows (raster lines) on the printing tape T by ejecting ink while moving in the main scanning direction. A congregation of these dot rows forms an image and therefore an image is printed by forming these dot rows. The head unit 40 has ten heads 41 and the ten heads 41 are arranged lined up in a staggered manner in the width direction (sub-scanning direction). And the ten heads are arranged in such a manner as ink can be ejected across the entire width of the printing tape T by moving the head unit 40 one time in the main scanning direction, that is, in such a manner as the sub-scanning direction width of the head unit 40 is wider than the width of the printing tape T.

Furthermore, a nozzle row Y that ejects yellow ink, a nozzle row M that ejects magenta ink, a nozzle row C that ejects cyan ink, and a nozzle row K that ejects black ink are formed on a lower face of each of the heads 41. In each nozzle row there are 360 nozzles lined up having a constant spacing (360 dpi) in the width direction. Furthermore, of two heads neighboring in the width direction (here description is given using a head 41(1) and a head 41(2) as an example), the two most near-side nozzles #359 and #360 of the far-side head 41(1) and the most far-side nozzles #1 and #2 of the near-side head 41(2) are positioned on same lines (that is, the nozzles are overlapping). It should be noted that in the present embodiment, the sub-scanning direction corresponds to the first direction and the main scanning direction corresponds to the second direction.

How Head Unit 40 Moves During Printing

FIGS. 4A to 4I are schematic diagrams for describing how the head unit 40 moves during printing. The printer 1 forms each dot row (raster line) by moving the head unit 40 four times in the main scanning direction. It should be noted that during printing the printing tape T is kept held on the sucking table 23 without being transported.

Figure 4A:
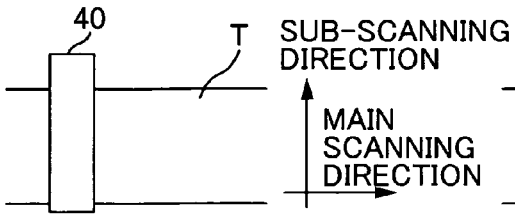
FIGS. 4A to 4I are schematic diagrams for describing how the head unit 40 moves during printing.
Figure 4B:
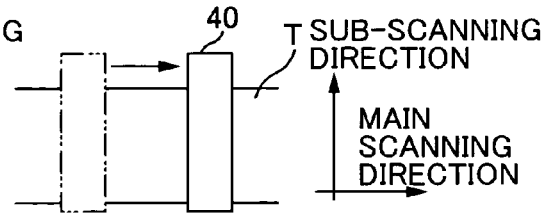
Figure 4C:
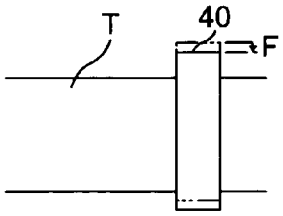
Figure 4D:
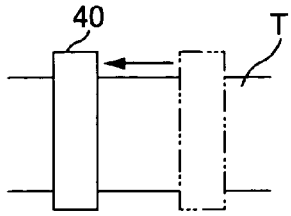
Figure 4E:
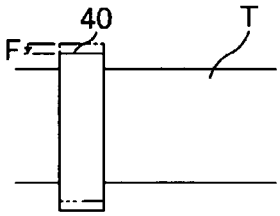
Figure 4F:
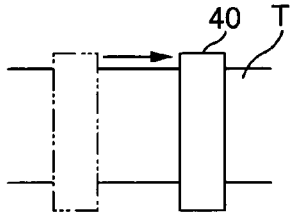
Figure 4G:
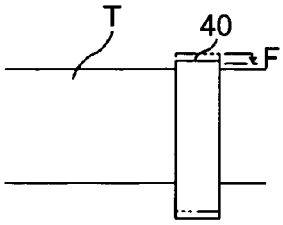
Figure 4H:
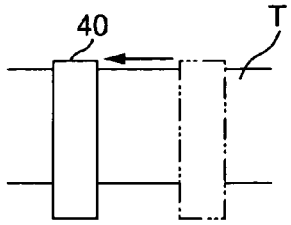
Figure 4I:
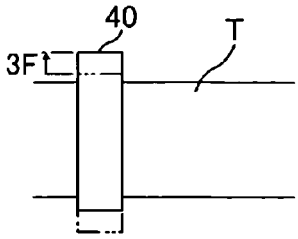

Before printing, the head unit 40 stands by at a home position (the position shown in FIG. 4A). During printing, first the head unit 40 is moved by the drive unit 30 in the main scanning direction from the downstream side to the upstream side (FIG. 4B). Then, during this movement (pass 1), ink is ejected from the nozzles of the head unit 40 across the entire width region of the printing tape T, so that dot rows of the pass 1 are formed on the printing tape T. Having been moved in the main scanning direction, the head unit 40 is then moved by the drive unit 30 in the sub-scanning direction from the far side to the near side (FIG. 4C); thereafter, ink is ejected from the nozzles across the entire width region of the printing tape T while the head unit 40 is again moved (pass 2) in the main scanning direction from the upstream side to the downstream side (FIG. 4D) so that dot rows of the pass 2 are formed. Here "pass" refers to a one time movement of the head unit 40 along the main scanning direction, and the numeral after the pass indicates the order in which the passes are carried out.

In this manner, the head unit 40 alternately carries out a main scanning direction movement (FIGS. 4B, 4D, 4F, and 4H) of the head unit 40 for forming dots, and a sub-scanning direction movement (FIGS. 4C, 4E, and 4G) of the head unit 40. In this way, a plurality of dot rows (raster line groups) are formed across the entire width region of the printing tape T. Then, after finishing the fourth movement in main scanning direction (pass 4, FIG. 4H), the head unit 40 moves in the sub-scanning direction to the far side (FIG. 4I) and is positioned in the home position shown in FIG. 4A. This completes a series of movements of the head unit 40 during printing.

Density Irregularities Originating in Ejection Characteristic Differences Among Heads 41

It is known that ink ejection characteristics vary due to individual differences of the heads 41. For example, there are cases in which, while ink is ejected easily from the nozzles of a certain head 41, ink is ejected with more difficulty from the nozzles of another head 41. Thus, in the case where printing is performed using the head unit 40, which has ten heads 41 having individual differences, so-called density irregularities may occur originating in differences of ejection characteristics among the heads 41.

Here, of the ten heads 41, description is given using a head 41(3), a head 41(4), and a head 41(5) as examples. Suppose that the head 41(3) has a characteristic of ejecting ink with difficulty (an ink ejection amount is less than an appropriate amount), the head 41(4) has a characteristic of ejecting ink normally (the ink ejection amount is appropriate), and the head 41(5) has a characteristic of ejecting ink easily (the ink ejection amount is more than an appropriate amount). For this reason, suppose that when it is necessary to form a dot having an appropriate ejection amount (hereinafter referred to as a medium dot), the head 41(3) forms a dot whose ejection amount is less than the appropriate amount (hereinafter referred to as a small dot), the head 41(4) forms a medium dot, and the head 41(5) forms a dot whose ejection amount is greater than the appropriate amount (hereinafter referred to as a large dot). It should be noted that a majority of the other heads 41 of the ten heads 41 form a medium dot in a same manner as the head 41(4).

Figure 5A:
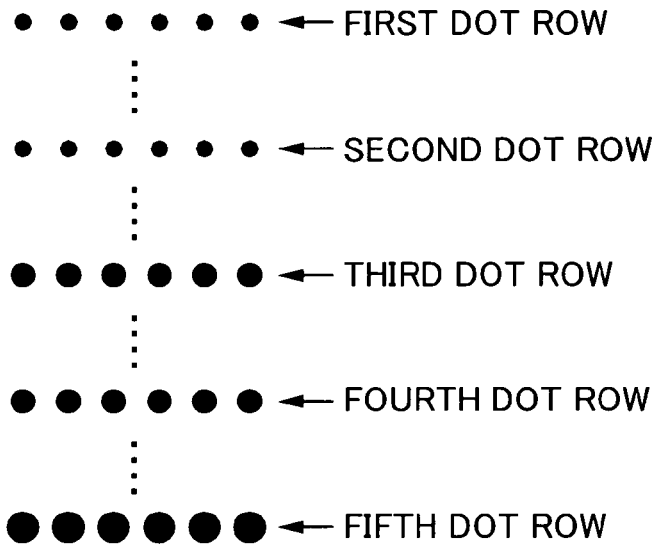
FIGS. 5A and 5B are diagrams for describing density irregularities originating in ejection characteristic differences among heads 41.
Figure 5B:
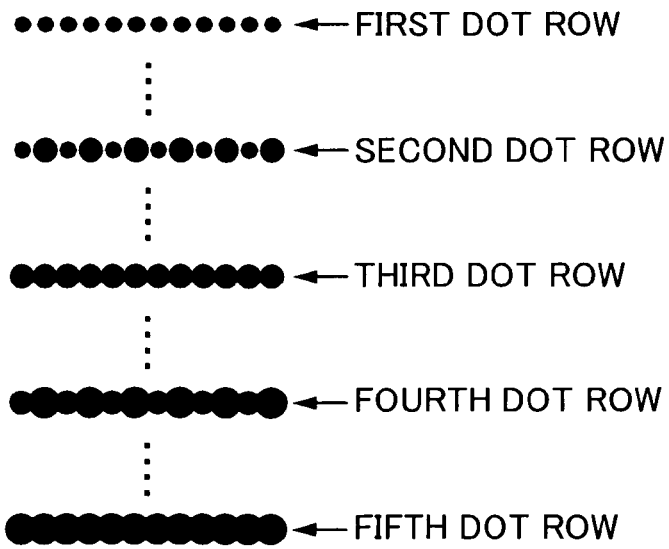

FIGS. 5A and 5B are diagrams for describing density irregularities originating in ejection characteristic differences among the heads 41. The dot rows shown in FIGS. 5A and 5B are formed in two passes, with FIG. 5A showing the dot rows after the pass 1 and the FIG. 5B showing the dot rows after the pass 2.

Of the five dot rows, a first dot row is formed by the head 41(3) in the pass 1 and pass 2. Thus, only small dots are lined up in the first dot row. A second dot row is formed by the head 41(3) in the pass 1 and the head 41(4) in the pass 2. Thus, small dots and medium dots are lined up alternately in the second dot row. A third dot row is formed by the head 41(4) in the pass 1 and pass 2, and only medium dots are lined up. A fourth dot row is formed by the head 41(4) in the pass 1 and the head 41(5) in the pass 2, and medium dots and large dots are lined up alternately. A fifth dot row is formed by the head 41(5) in the pass 1 and pass 2, and only large dots are lined up.

In this case, the first dot row is formed by only small dots and appears lighter compared to a dot row formed by medium dots (dots having an appropriate ejection amount). That is, this is perceived as a density irregularity. Similarly, the fifth dot row is formed by only large dots and appears darker compared to a dot row formed by medium dots. That is, this is perceived as a density irregularity. And when the number of first dot rows and fifth dot rows increases, the density irregularities become conspicuous, thereby resulting in an even greater reduction in image quality.

On the other hand, the third dot row is formed by only medium dots, and therefore it has an appropriate density. And since medium dots constitute half of the second and fourth dot rows, overall the density is neutralized even when these rows also contain small dots or large dots, so that the second and fourth dot rows tend not to be perceived as having density irregularities.

In this way, in a configuration in which dot rows are formed using a plurality of the heads 41 having different ink ejection characteristics, a problem may occur in which density irregularities become conspicuous in the case where a dot row is formed by only a single head 41 (the above-mentioned head 41(3) and head 41(5)).

Relationship between Total Sub-Scanning Amount of Head Unit During Printing and Width of Head Unit The printer 1 according to the present embodiment is configured to eject ink across the entire width region of the printing tape T in the four main scanning direction movements (the pass 1 to pass 4). This is for forming dot rows having a spacing narrower than the nozzle pitch by moving the head unit 40 in the sub-scanning direction by units of 720 dpi because the image resolution (for example, a sub-scanning direction resolution of 720 dpi) is finer than the nozzle pitch (360 dpi).

On the other hand, the head unit 40 moves three times in the sub-scanning direction (FIGS. 4C, 4E, and 4G) between the four passes 1 to 4. And in order to eject ink across the entire width region of the printing tape T in the passes 1 to 4, the sub-scanning direction width of the head unit 40 varies in response to the magnitude of the total movement amount of the three movements (hereinafter also referred to as "total sub-scanning amount"). Description is given regarding this point using FIGS. 6A and 6B.

Figure 6A:
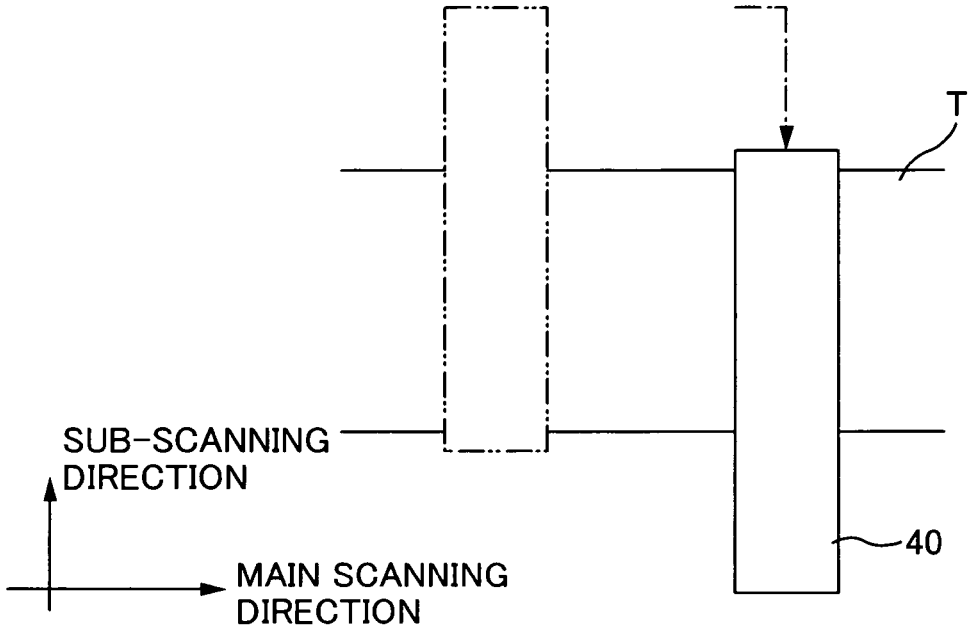
FIG. 6A shows the head unit 40 in the case where the total sub-scanning amount is increased.
Figure 6B:
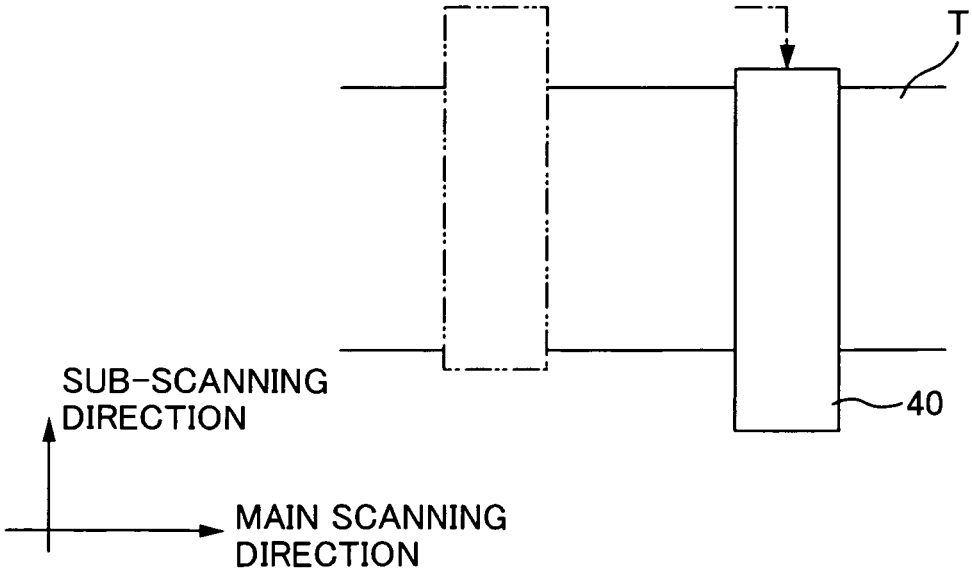
FIG. 6B shows the head unit 40 in the case where the total sub-scanning amount is reduced.

FIG. 6A shows the width of the head unit 40 in the case where the total sub-scanning amount is increased. FIG. 6B shows the width of the head unit 40 in the case where the total sub-scanning amount is reduced. It should be noted that the left-side head units 40 indicated by the dotted line in FIGS. 6A and 6B is in a state immediately before the first movement in the main scanning direction (pass 1) and the right-side head units 40 indicated by solid lines are in a state immediately before the fourth movement in the main scanning direction (pass 4). Thus, the amount of sub-scanning direction displacement between the dotted line head units 40 and the solid line head units 40 is the total sub-scanning amount of that head unit 40.

As is evident in FIGS. 6A and 6B, as total sub-scanning amounts becomes larger, the sub-scanning direction width of the head unit 40 becomes larger in such a manner to eject ink across the entire width region of the printing tape T. That is, the number of heads 41 constituting the head unit 40 is greater. And when the width of the head unit 40 becomes larger, there is a risk that the printer 1 will need to be large size to insure installation space for the head unit 40.

Print Processing According to Present Embodiment

In order to constrain the above-mentioned problem, namely conspicuous density irregularities and increases in the sub-scanning direction width of the head unit 40, the printer 1 executes print processing to be described below.

In the print processing, so-called overlap printing is carried out. The head unit 40 moves two times (m times) in the main scanning direction, to form a single dot row (raster line). Also, an image, which is a congregation of raster lines, has the resolution of 720 dpi in both the main scanning direction and the sub-scanning direction, and the resolution of the image in the sub-scanning direction is twice (n times) the nozzle pitch (360 dpi). The print processing is characterized in that an image is formed, (1) by setting the total movement amount (total sub-scanning amount) of the head unit 40 when the head unit 40 has moved in the sub-scanning direction three times, larger than the effective nozzle width (to be described later) in the sub-scanning direction of a single head 41 multiplied by (m×n−1), and also smaller than the effective nozzle width× (m×n), and (2) by setting the respective movement amounts (sub-scanning amount) of the head unit 40 in the sub-scanning direction when the head unit 40 has carried out the foregoing three movements, larger than the effective nozzle width of a single head 41.

The various operations of the printer 1 when print processing is executed are mainly achieved by the controller 10. In particular, in the present embodiment, the operations are achieved by a CPU 12 executing programs stored in a memory 13. These programs are constituted by program code for performing various operations to be described below.

Figure 7:
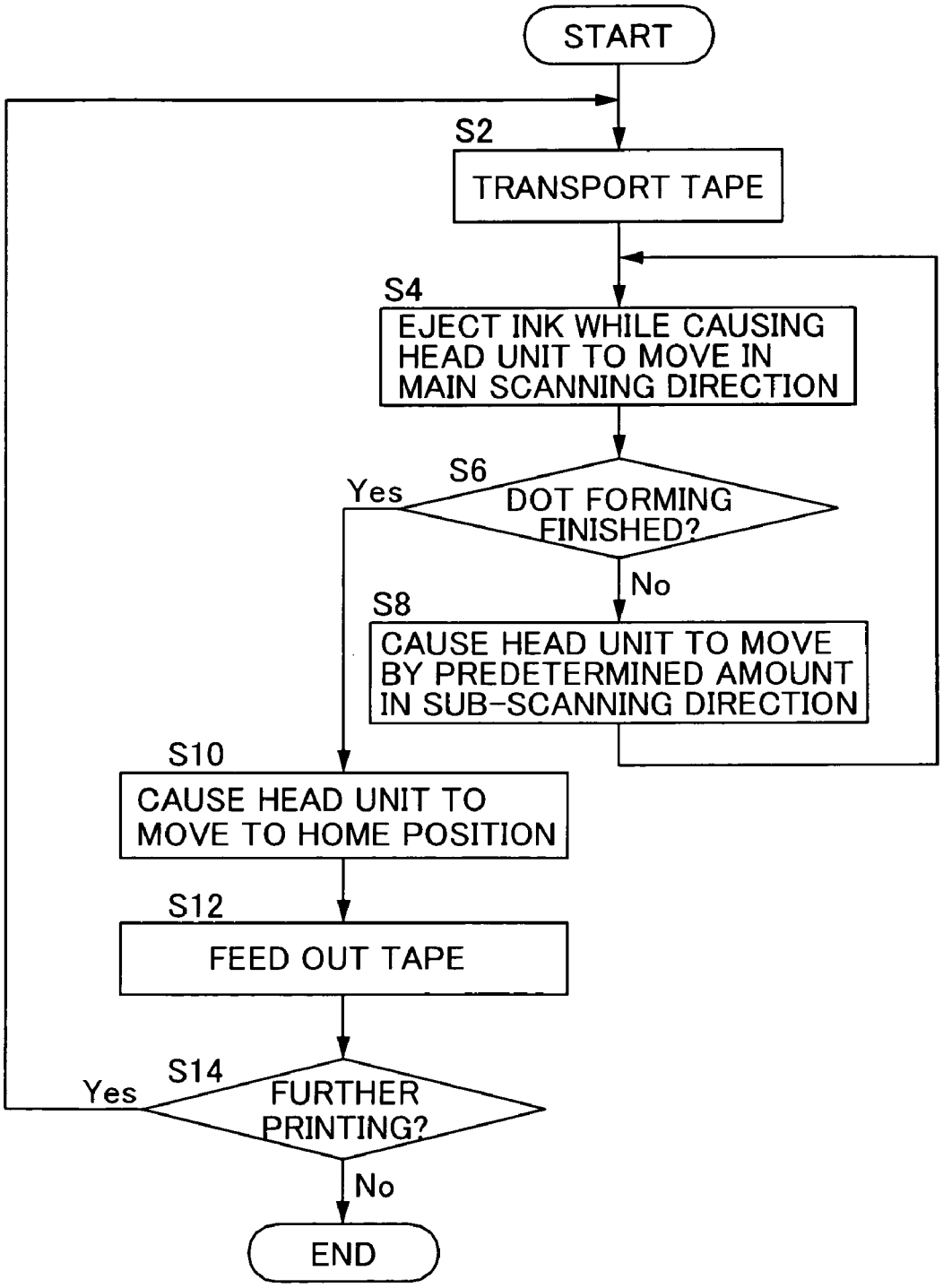
FIG. 7 is a flowchart for describing the present print processing.

FIG. 7 is a flowchart for describing the print processing. The flowchart shown in FIG. 7 begins when the controller 10 receives print data from a computer 90 (FIG. 1) via an interface 11.

In the print processing, first the controller 10 feeds the printing tape T into the printing region with the transport unit 20 (step S2). That is, the feed rollers 21 feed the printing tape T before printing onto the sucking table 23, which is the printing region.

Next, the controller 10 causes ink to be ejected from the nozzles while causing the drive unit 30 to move the head unit 40 (FIG. 4B) in the main scanning direction (step S4). That is, the controller 10 forms dot rows of the pass 1 on the printing tape T that is held on the sucking table 23. Since the image (printed item) is formed in four passes, when the dot rows of the pass 1 are formed, the controller 10 causes the drive unit 30 to move the head unit 40 (FIG. 4C) in the sub-scanning direction by a definite sub-scanning amount (step S6: No, step S8).

Then, until dot formation processing is completed, the controller 10 alternately carries out formation of dot rows accompanying the main scanning direction movements (FIGS. 4D, 4F, and 4H) of the head unit 40, and the sub-scanning direction movements (FIGS. 4E and 4G) of the head unit 40 (steps S4 to S8).

Here, description is given concerning overlap printing according to the present embodiment. Overlap printing refers to a printing method in which a single dot row (raster line) is formed using two or more nozzles. Specifically, one nozzle forms a dot row intermittently every several dots in the main scanning direction. Then, another nozzle forms a dot row so as to complement the already-formed intermittent dot row.

Figure 8:
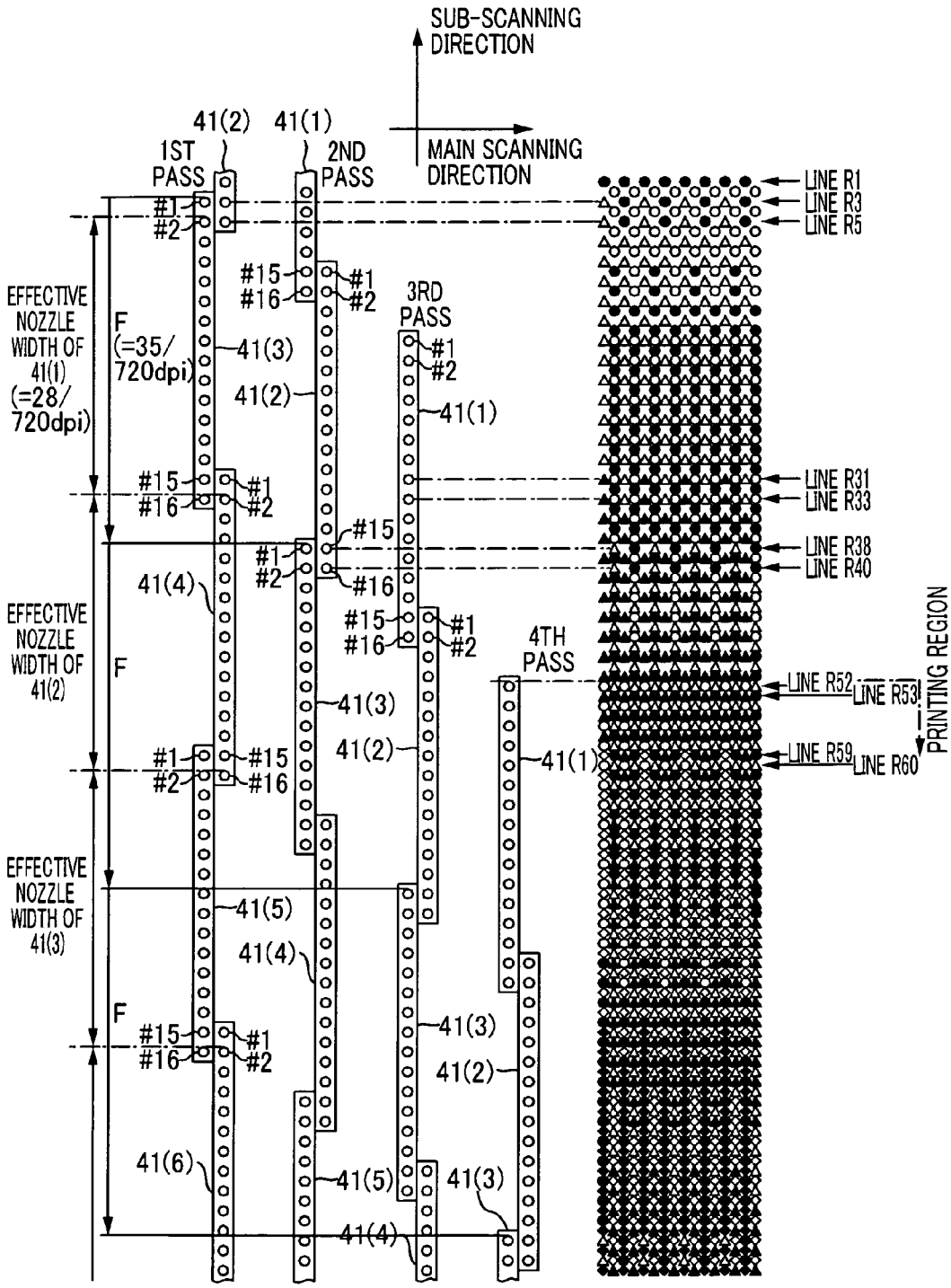
FIG. 8 is a diagram for describing overlap printing according to the present embodiment.
Figure 9:
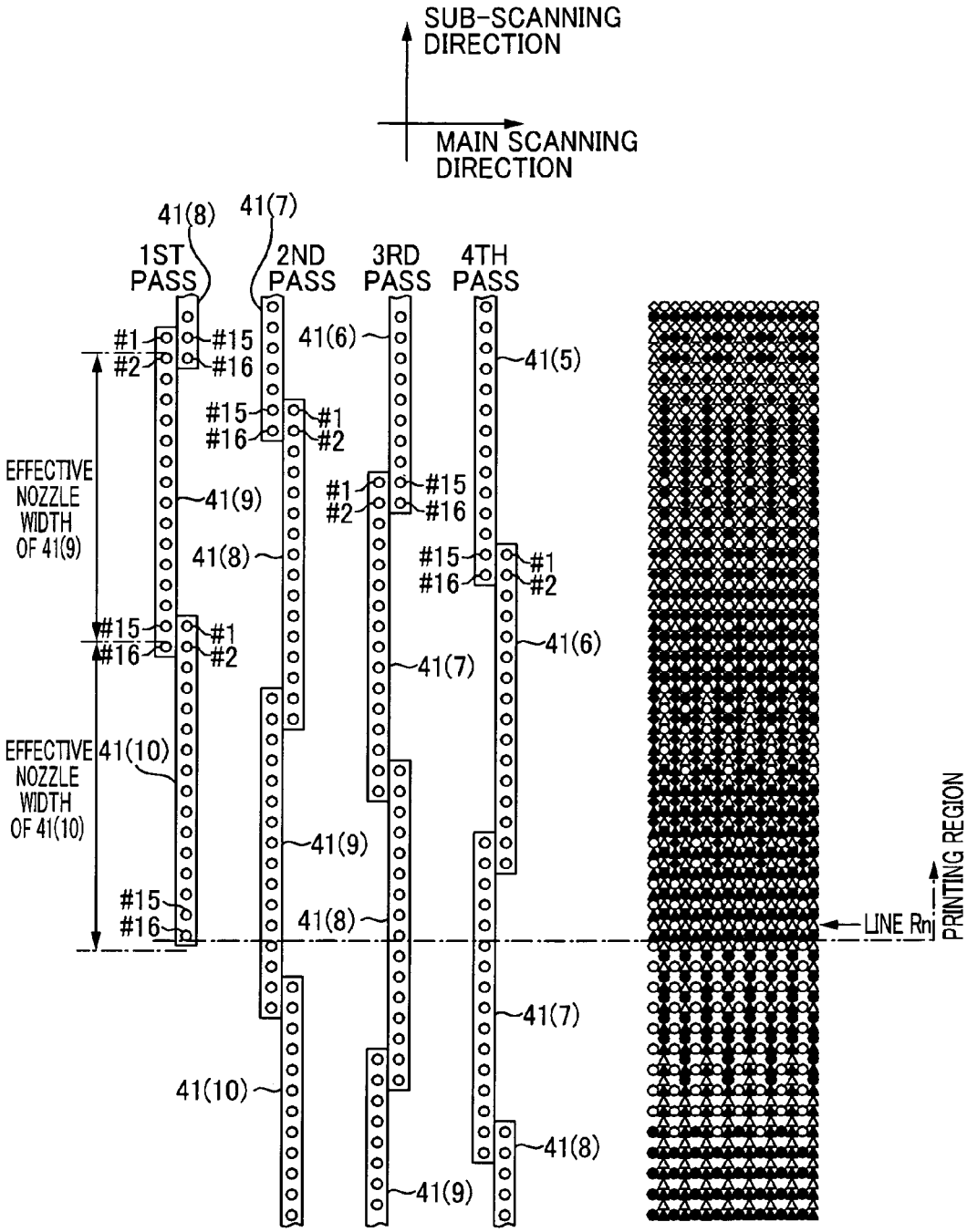
FIG. 9 is a diagram for describing overlap printing according to the present embodiment.

FIGS. 8 and 9 are diagrams for describing overlap printing according to the present embodiment. However, in order to simplify description, only the nozzle row C is shown of the four nozzle rows (nozzle row Y, nozzle row M, nozzle row C, and nozzle row K) of each of the heads 41, and the number of nozzles in each of the heads 41 is reduced to 16 nozzles. For this reason, FIG. 8 shows how dots are formed and the positions in the passes 1 to 4 of the nozzle row C of the sub-scanning direction far-side heads (head 41(1), head 41(2) and so on) of the ten heads 41; FIG. 9 shows how dots are formed and the positions in the passes 1 to 4 of the nozzle row C of the sub-scanning direction near-side heads (head (10), head 41(9) and so on). Furthermore, in FIGS. 8 and 9, the dots formed by the nozzles of the head 41(1) and the head 41(7) are shown as white dots (o), the dots formed by the nozzles of the head 41(2) and the head 41(8) are shown as black dots (●), the dots formed by the nozzles of the head 41(3) and the head 41(9) are shown as white triangles (Δ), the dots formed by the nozzles of the head 41(4) and the head 41(10) are shown as black triangles (▲), the dots formed by the nozzles of the head 41(5) are shown as white rhombuses (◇), and the dots formed by the head 41(6) are shown as black rhombuses (◆).

Dots are formed in the pixels of the printing region by the nozzles of the nozzle row C in the passes 1 to 4. Here, the "pixel" refers to a square grid that is virtually determined on the printing tape T for regulating the positions at which dots are to be formed. Further still, in order to specify and describe the pixels, pixels lined up in the main scanning direction are expressed as "lines" and pixels lined up in the sub-scanning direction are expressed as "rows". It should be noted that the pixels shown in FIGS. 8 and 9 are lined up having spacings of 720 dpi in both the main scanning direction and the sub-scanning direction.

First, in the pass 1, ink is ejected from the nozzles of each of the heads 41. And dot rows are formed in pixels in odd numbered lines (lines R1, R3, R5, and so on) and odd numbered rows (rows 1, 3, 5, and so on) shown in FIG. 8. For example, ink is ejected from the nozzle #1 of the head 41(3) and dots are formed in the pixels of odd numbered rows in the line R3. Similarly, ink is ejected from the nozzle #2 of the head 41(3) and dots are formed in the pixels of odd numbered rows in the line R5. In this way, each nozzle forms dots with a one pixel spacing therebetween in the main scanning direction in each line corresponding to their respective positions.

It should be noted that the manner of ink ejection of overlapping nozzles of two heads neighboring in the width direction (here description is given using the head 41(3) and the head 41(4) as examples) is different from the manner of ink ejection of nozzles that do not overlap (for example, the nozzle #3 of the head 41(3)). That is, in the pass 1, the nozzle #15 and nozzle #16 of the far-side head 41(3) in the width direction form dot rows in the pixels of rows 3, 7, 11, and so on in the lines R31 and R33, and the nozzle #1 and nozzle #2 of the near-side head 41(4) form dot rows in the pixels of rows 1, 5, 9, and so on. In this way, the nozzles of two neighboring heads 41 eject ink alternately and form dot rows in pixels of odd numbered rows.

After the pass 1 is finished, the head unit 40 moves by a predetermined sub-scanning amount F (specifically, 35/720 dpi) from the far side to the near side in the sub-scanning direction as a first movement in the sub-scanning direction during printing.

In the pass 2 after the movement of the head unit 40, dot rows are formed in pixels of even numbered lines (lines R2, R4, R6, and so on) and even numbered rows (rows 2, 4, 6, and so on). For example, ink is ejected from the nozzle #1 of the head 41(3) and dots are formed in the pixels of even numbered rows in the line R38. Similarly, ink is ejected from the nozzle #2 of the head 41(3) and dots are formed in the pixels of even numbered rows in the line R40. Furthermore, in the pass 2, the nozzle #15 and nozzle #16 of the far-side head 41(3) in the width direction of the neighboring heads form dot rows in the pixels of rows 4, 8, 12, and so on, and the nozzle #1 and nozzle #2 of the near-side head 41(4) form dot rows in the pixels of rows 2, 6, 10, and so on. That is, in a same manner as in the pass 1, the nozzles of two neighboring heads 41 eject ink alternately and form dots in pixels of even numbered rows (the same is true in regard to the pass 3 and the pass 4, which are described later).

After the pass 2 is finished, the head unit 40 moves by a predetermined sub-scanning amount F (35/720 dpi) as a second movement in the sub-scanning direction.

Similarly, in the pass 3, dot rows are formed in pixels of odd numbered lines and even numbered rows. As a result, a dot row of the line R53 (odd numbered line) for example is completed by the pass 1 and pass 3.

After the pass 3 is finished, the head unit 40 moves by a sub-scanning amount F (35/720 dpi) as a third movement in the sub-scanning direction, the sub-scanning amount F having a same magnitude as the sub-scanning amounts in the first and second movements. In this way, the movement amount F in each of the three movements in the sub-scanning direction by the head unit 40 is of the same magnitude. Furthermore, each movement amount F and the total of the three times of sub-scanning amounts of the head unit 40 (total sub-scanning amount 3F) are set so as to satisfy a predetermined relationship with the effective nozzle width of a single head 41, which is described below.

First, description is given regarding effective nozzles. Effective nozzles are conceived differently depending on whether or not there are overlapping nozzles (mentioned earlier) between neighboring heads 41. In the case where there are no overlapping nozzles, the effective nozzles of the heads 41 are all the nozzles of the nozzle rows (see FIG. 11). On the other hand, in the case where there are overlapping nozzles, the effective nozzles of the heads 41 are determined giving consideration to the overlapping nozzles. Specifically, the effective nozzles of a head 41 are constituted by non-overlapping nozzles among nozzle rows of that head 41, and nozzles of the overlapping nozzles of that head 41 evenly distributed in relation to another head 41.

Here, description is given regarding how the overlapping nozzles are distributed evenly. For example, in FIG. 8, the nozzle #15 and nozzle #16 of the head 41(3) overlap the nozzle #1 and nozzle #2 of the head 41(4). In this case, the overlapping nozzles are distributed evenly in such a manner as, of the nozzle #15 and the nozzle #16, the nozzle #15 is included in the effective nozzles of the head 41(3), and, of the nozzle #1 and nozzle #2, the nozzle #2 is included in the effective nozzles of the head 41(4). In this way, half of the overlapping nozzles of a head 41 are distributed to that head 41 so as to be included in its effective nozzles.

The ten heads 41 of the present embodiment have overlapping nozzles respectively, and the effective nozzles of the heads 41 are as follows. There are 15 effective nozzles in the head 41(1): the nozzle #1 to nozzle #14, and the nozzle #15 of the nozzle #15 and nozzle #16 that overlap the nozzle #1 and nozzle #2 of the head 41(2). On the other hand, there are 14 effective nozzles in the head 41(2): the nozzle #2 of the nozzle #1 and nozzle #2 that overlap the nozzle #15 and nozzle #16 of the head 41(1), the nozzle #3 to nozzle #14, and the nozzle #15 of the nozzle #15 and nozzle #16 that overlap the nozzle #1 and nozzle #2 of the head 41(3). In a similar manner to the head 41(2), the effective nozzles of the head 41(3) to the head 41(9) are the nozzle #2 to the nozzle #15. On the other hand, there are 15 effective nozzles in the head 41(10): the nozzle #2 of the nozzle #1 and nozzle #2 that overlap the nozzles of the head 41(9), and the nozzle #3 to nozzle #16.

Next, description is given regarding the effective nozzle width, which is determined from the aforementioned effective nozzles. The effective nozzle width is the width of effective nozzles in the sub-scanning direction (the effective nozzles are lined up having an interval of 2/720 dpi in the sub-scanning direction). In the present embodiment, the effective nozzle width of the head 41(1) and the head 41(10) is 30/720 dpi since there are 15 effective nozzles. On the other hand, the effective nozzle width of the head 41(2) to the head 41(9) is 28/720 dpi since there are 14 effective nozzles. And in the printer 1, the movement amount F (35/720 dpi) of the head unit 40 in the sub-scanning direction is set larger than the smaller effective nozzle width (28/720 dpi) of the two effective nozzle widths.

Then, the total sub-scanning amount 3F and the effective nozzle width (28/720 dpi) are set to satisfy the following relationship. As described above, a single raster line is formed as a result of the head unit 40 moving m times (twice) in the main scanning direction, and the resolution of the image (720 dpi) is n times (twice) the nozzle pitch (360 dpi). In such a case, in the printer 1, the total sub-scanning amount 3F during printing by the head unit 40 (105/720 dpi) is set larger than the effective nozzle width (28/720 dpi)×(m×n−1) and also smaller than the effective nozzle width (28/720 dpi)×(m×n). In the present embodiment, the values of m and n are each 2, and therefore the total sub-scanning amount 3F (105/720 dpi) is larger than (28/720 dpi)×3=(84/720 dpi), and smaller than (28/720 dpi)×4=(112/720 dpi).

Description of overlap printing is continued here. In the pass 4, dot rows are formed in pixels in even numbered lines and odd numbered rows. As a result, a dot row of the line R52 (even numbered line) for example is completed by the pass 2 and pass 4. In this manner, in the overlap printing of the present embodiment, a single dot row is formed using two different nozzles.

Here, examination is given regarding which heads 41 are used to form dot rows (raster lines) of the printing region with nozzles of those heads 41. Here, dot rows of the printing region refer to dot rows that are completed as the dot row of the line R52, and are dot rows of line R52 to line Rn (FIG. 9) in the present embodiment.

All the dot rows in the printing region are formed by the nozzles of two (or three) different heads 41, as shown in FIGS. 8 and 9. That is, dot rows in the odd numbered lines (line R53 for example) are formed by the nozzles of different heads 41 in the pass 1 and pass 3, and the dot rows in the even numbered lines (line R52 for example) are formed by the nozzles of different heads 41 in the pass 2 and pass 4. The dot rows are each formed by the nozzles of different two (or three) heads 41 in this manner because the sub-scanning amount F of the head unit 40 is larger than the effective nozzle width of a single head 41 (28/720 dpi).

The dot rows formed by the nozzles of two different heads 41 are dot rows, such as the line R60, formed only by non-overlapping nozzles (the nozzle #5 of the head 41(1) and the nozzle #12 of the head 41(3)). In contrast, the dot rows formed by the nozzle of three different heads 41 are dot rows, such as the line R59, formed by overlapping nozzles (the nozzle #15 of the head 41(4) and the nozzle #1 of the head 41(5)) and non-overlapping nozzles (the nozzle #8 of the head 41(2)).

Further, when two neighboring dot rows in the printing region are examined, such two dot rows are formed by the nozzles of four (or five) different heads 41. For example, the nozzles forming the dot rows in the lines R52 and R53 are nozzles of four different heads, the head 41(1), head 41(2), head 41(3), and head 41(4). Specifically, the head 41(1) and head 41(3) form the dot row in the line R52, and the head 41(2) and head 41(4) form the dot row in the line R54. Also, the nozzles forming the dot rows in the lines R59 and R60 are nozzles of five different heads, the head 41(1), head 41(2), head 41(3), head 41(4) and head 41(5). Specifically, the head 41(1) and head 41(3) form the dot row in the line R60, and the head 41(2), head 41(4) and head 41(5) form the dot row in the line R59. In this manner, a single head 41 do not form neighboring dot rows.

Description was given above concerning overlap printing according to the present embodiment. Description of the present print processing continues now returning to the flowchart shown in FIG. 7. When the dot formation processing is completed by forming the dot rows in the pass 4 (step S6: yes), or in other words, when the printed item (image) is printed on the printing tape T, the controller 10 causes the drive unit 30 to move the head unit 40 in the sub-scanning direction (FIG. 4I) to position the head unit 40 in the home position (step S10).

Next, the controller 10 feed out the printing tape T on which dots have been formed (printing tape T that has been printed) from the printing region using the transport unit 20 (step S12). That is, the feed out rollers 22 feed out from the printing region the printing tape T that has been printed.

In the case where there is further print data to be printed (step S14: yes), the controller 10 repeats the above-described operations (steps S2 to S12) and carries out printing on the printing tape T. On the other hand, in the case where there is no more print data (step S14: no), the controller 10 finishes the print processing.

Effectiveness of Print Processing

In the above-described print processing, it is possible to suppress deterioration in image quality by the controller 10 forming an image under setting in such a manner as the sub-scanning amount F (35/720 dpi) in the sub-scanning direction of the head unit 40 is larger than the effective nozzle width (28/720 dpi).

In other words, as described above, density irregularities tend to become more conspicuous (see FIG. 5) for greater numbers of raster lines formed by the nozzles of only a single head 41 (as described in FIG. 5, the head 41(3) having a small ejection amount and the head 41(5) having a large ejection amount). Accordingly, by setting the one-time sub-scanning amount F of the head unit 40 larger than the effective nozzle width, the dot rows (raster lines) in the printing region are each formed by the nozzles of two or three different heads 41 (FIGS. 8 and 9). For this reason, no raster line formed by a single head 41 is included. Therefore, density irregularities can be kept from becoming conspicuous. As a result, deterioration in image quality can be suppressed.

It should be noted that by setting the sub-scanning amount F larger than the effective nozzle width, it is possible to suppress from becoming conspicuous the density irregularities originating at the linkages between neighboring heads 41. That is, since the head unit 40 is a component in which the ten heads 41 are linked in the sub-scanning direction, it is known that when the positional accuracy of the linkages is poor, density irregularities may occur due to this. And in the case where an image is formed in a plurality of passes, when the linkages in the pass 1 and the linkages in the pass 2 for example match up in the sub-scanning direction, density irregularities originating in the linkages become conspicuous. In contrast to this, by setting the sub-scanning amount F larger than the effective nozzle width as in this print processing, it is possible to suppress density irregularities from becoming conspicuous since the linkages between the heads in the passes 1 to 4 are distributed as shown in FIGS. 8 and 9.

In addition, it is possible to suppress increases in the sub-scanning direction width of the head unit 40 by the controller 10 forming an image under setting the total sub-scanning amount 3F (105/720 dpi) in the sub-scanning direction of the head unit 40 larger than the effective nozzle width of a single head 41 in the sub-scanning direction multiplied by (m×n−1) and smaller than the effective nozzle width×(m×n).

That is, as described above, the sub-scanning direction width of the head unit 40 becomes larger for larger total sub-scanning amounts of the head unit 40 (see FIG. 6). Consequently, in the case where the value of m and n is 2, by setting the total sub-scanning amount 3F larger than the effective nozzle width×3 and smaller than the effective nozzle width×4, it is possible to reduce the total sub-scanning amount of the head unit 40 while forming each raster line in the printing region by the nozzles of two or three different heads 41 (FIGS. 8 and 9). As a result, increases in the width of the head unit 40 (increases in the number of heads 41) can be suppressed even in the case where ink is ejected across the entire width region of the printing tape T in the passes of overlap printing.

Consequently, with the above-described print processing, it is possible to suppress deterioration in image quality and to suppress increases in the sub-scanning direction width of the head unit 40. Moreover, in the above-described print processing, the controller 10 forms n number of (two) successive raster lines by ejecting ink from the nozzles of m×n (=4) number of heads 41, and thereby density irregularities can be more effectively suppressed in the n number of successive raster lines.

Further still, in the above-described print processing, the controller 10 uses a same magnitude (35/720 dpi) for each movement amount (sub-scanning amount F) in the three movements of the head unit 40 in the sub-scanning direction.

For this reason, the dot rows are formed cyclically and positions of occurrences of density irregularities are distributed systematically; thereby, it is possible to effectively suppress density irregularities from becoming conspicuous.

Print Processing according to Second Embodiment

In the print processing of the above-described embodiment (first embodiment), overlap printing is carried out as shown in FIGS. 8 and 9. In the second embodiment, interlaced printing is carried out instead of overlap printing (it should be noted that interlaced printing is carried out as well in the first embodiment). Here, interlaced printing refers to a printing method in which a raster line that is not formed is sandwiched between raster lines that are formed in a single pass. That is, successive raster lines are formed by complementing raster lines that are not completed in a single pass in other passes.

The resolution of images of the second embodiment is 720 dpi in the main scanning direction and 1440 dpi in the sub-scanning direction. The resolution of 1440 dpi in the sub-scanning direction is four times (n=4) the nozzle pitch (360 dpi). Also, the head unit 40 forms a single raster line during one time movement, and therefore m=1. In addition, also in the second embodiment, the head unit 40 carries out the movement in four times in the main scanning direction and the movement in three times in the main scanning direction alternately, as shown in FIG. 4.

Then, in the print processing of the second embodiment as well, the controller 10 forms an image (1) by setting the total movement amount of the head unit 40 when the head unit 40 has moved in the sub-scanning direction three times, larger than the effective nozzle width of a single head 41 in the sub-scanning direction multiplied by (m×n−1), and also smaller than the effective nozzle width×(m×n), and (2) by setting respective movement amounts of the head unit 40 in the sub-scanning direction, when the head unit 40 has carried out the foregoing three movements, larger than the effective nozzle width.

Figure 10:
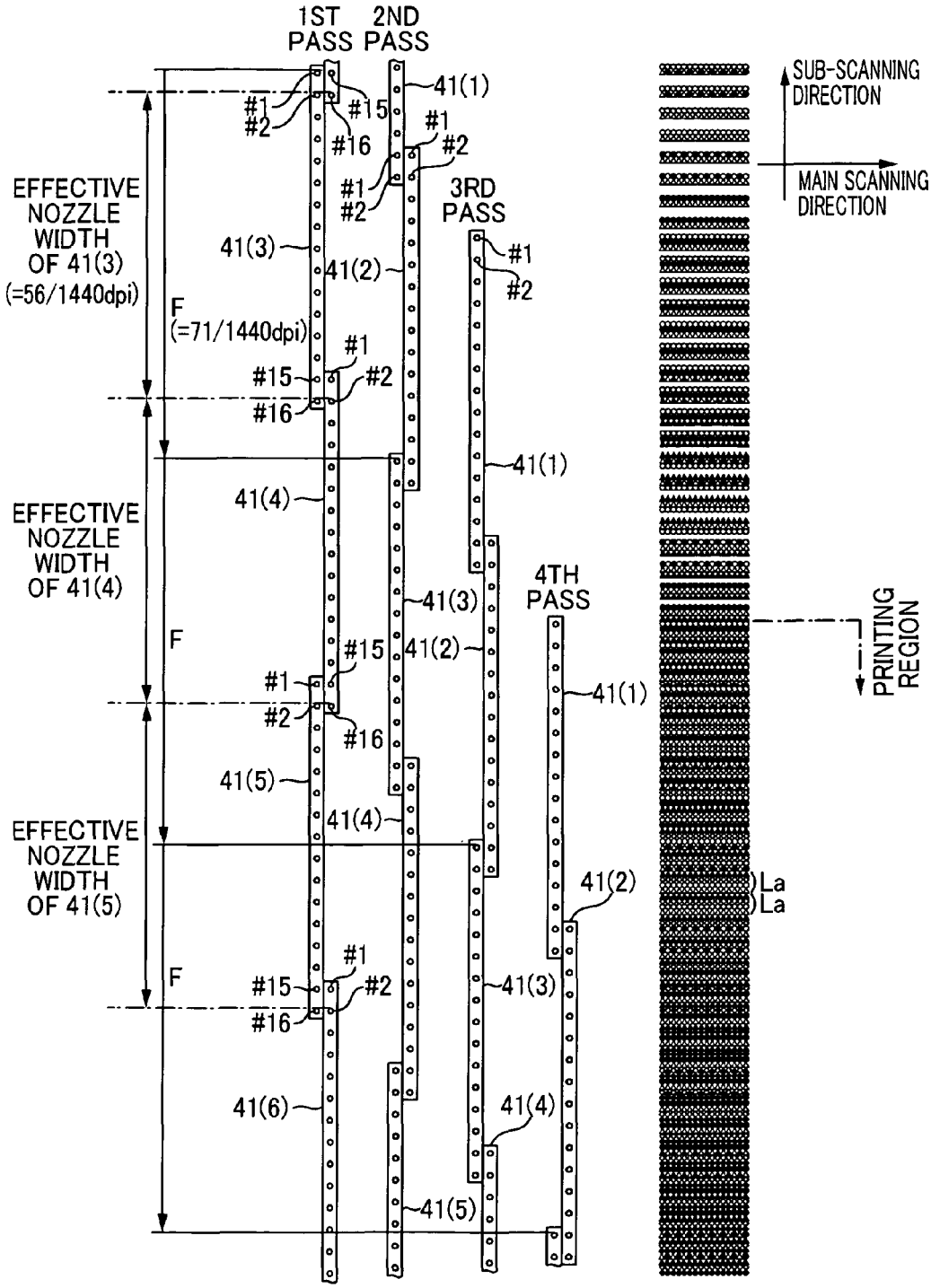
FIG. 10 is a diagram for describing interlaced printing according to a second embodiment.

FIG. 10 is a diagram for describing interlaced printing according to the second embodiment. As in FIG. 8, in FIG. 10, only the nozzle row C is shown. And dots formed by the nozzles of the head 41(1) are shown as white dots (○), the dots formed by the nozzles of the head 41(2) are shown as black dots (●), the dots formed by the nozzles of the head 41(3) are shown as white triangles (Δ), the dots formed by the nozzles of the head 41(4) are shown as black triangles (▲), the dots formed by the nozzles of the head 41(5) are shown as white rhombuses (◇), and the dots formed by the head 41(6) are shown as black rhombuses (◆).

The one-time sub-scanning amount F of the head unit 40 during printing is 71/1440 dpi, and is larger than the effective nozzle width of a single head 41 {28/720 dpi (=56/1440 dpi)}. Here, dot rows in the printing region formed by the head unit 40 that moves at such a sub-scanning amount are examined.

The dot rows in the printing region are formed on the basis of a certain regularity. That is, successive four raster lines (these raster lines are formed respectively by different heads 41) form a group and this group is repeatedly formed. Specifically, La (successive four raster lines) shown in FIG. 10 is repeatedly formed, and raster lines before and after the La are also formed by repetition of the group of four raster lines. In this manner, due to the sub-scanning amount F being set larger than the effective nozzle width, successive raster lines are not formed by a single head 41. Therefore, even if a raster line causing the density irregularity is formed by a certain head 41, such a raster line is formed in a distributed manner rather than in a successive manner. Accordingly, density irregularities can be kept from becoming conspicuous and, as a result, deterioration in image quality can be suppressed.

The total sub-scanning amount F3 of the head unit 40 is 213/1440 dpi. This total sub-scanning amount F3 is larger than the effective nozzle width×(m×n−1), namely, 56/1440 dpi×3 (=168/1440 dpi), and smaller than the effective nozzle width×(m×n), namely, 56/1440 dpi×4 (=224/1440 dpi). As a result, as in the first embodiment, increases in the width of the head unit 40 (increases in the number of heads 41) can be suppressed even in the case where ink is ejected across the entire width region of the printing tape T in the passes of interlaced printing.

It should be noted that although in the second embodiment the resolution in the sub-scanning direction is 1440 dpi, which is four times (n=4) the nozzle pitch (360 dpi), this is not a limitation. For example, the resolution in the sub-scanning direction may be 720 dpi, which is twice (n=2) the nozzle pitch. In short, n may be 2 or any larger natural number so long as interlaced printing can be carried out.

Other Embodiments

A liquid ejecting apparatus or the like according to the invention is described above, based on the embodiments; but the foregoing embodiments of the invention are for the purpose of elucidating the invention and are not to be interpreted as limiting the invention. The invention can of course be altered and improved without departing from the gist thereof and equivalents are intended to be embraced therein.

Furthermore, in the foregoing embodiments, the liquid ejecting apparatus was realized in an inkjet printer, but there is no limitation to this, and it can also be realized in a liquid ejecting apparatus that ejects (emits jets of) a liquid other than ink (for example, liquid substances in which molecules of functional materials disperses, and fluid substances such as gels). For example, also possible are: a liquid-substance ejecting apparatus that ejects a liquid substance containing in a dispersing or dissolving manner a material such as an electrode material or coloring material used in manufacturing of liquid crystal displays, color filters, EL (electroluminescence) displays, and surface-emitting optical displays or the like; a liquid ejecting apparatus that ejects a bioorganic substance used in biochip manufacturing; and a liquid ejecting apparatus that is used as a precision pipette and ejects a liquid, which is a specimen. Further still, also possible are: a liquid ejecting apparatus that performs pinpoint ejection of a lubricant onto precision machinery such as watches and cameras; a liquid ejecting apparatus that ejects onto a substrate a transparent resin liquid such as an ultraviolet curing resin or the like in order to form a minute hemispherical lens (optical lens) or the like used in optical communications devices or the like; a liquid ejecting apparatus that ejects an etching liquid such as an acid or an alkali in order to perform etching on a substrate or the like; and a fluid-substance ejecting apparatus that ejects a gel. The invention can be applied to an ejecting apparatus of any type among these.

Furthermore, in the foregoing embodiments, the raster lines were formed (FIGS. 8 and 9) by moving the head unit 40 four times in the main scanning direction and three times in the sub-scanning direction while the printing tape T was kept stationary, but there is no limitation to this. For example, the raster lines may be formed by moving the head unit 41 only in the main scanning direction and moving the printing tape T in the sub-scanning direction. Moreover, the raster lines may be formed by moving the printing tape T in the main scanning direction and the sub-scanning direction but not moving the head unit 41. That is, raster lines may be formed by moving the head unit 40 relative to the printing tape T in the main scanning direction and the sub-scanning direction.

Also, in the foregoing embodiments, interlaced printing (n=2 or 4) is carried out as shown in FIGS. 8 to 10. However, only overlap printing may be carried out without carrying out interlaced printing (namely, n=1). For example, overlap printing under n=1 and m=2 may be carried out (m may be any natural number larger than 2).

Furthermore, in the foregoing embodiments, overlapping nozzles of neighboring heads 41 (for example, the nozzle #15 of the head 41(3) and the nozzle #1 of the head 41(4)) ejected ink alternately, to form a single raster line (that is, ink was ejected from both of two nozzles that overlapped). However, there is no limitation to this.

For example, ink may be ejected from only one of the overlapping nozzles of neighboring heads 41. Specifically, in regard to the head 41(3), of the overlapping nozzles (nozzles #1, #2, #15, and #16), it is acceptable that ink is ejected from the nozzles #1 and #2 and ink is not ejected from the nozzles #15 and #16. Similarly, in regard to the head 41(4) also, of the overlapping nozzles (nozzles #1, #2, #15, and #16), it is acceptable that ink is ejected from the nozzles #1 and #2 and ink is not ejected from the nozzles #15 and #16. In this case, the number of effective nozzles (14 nozzles) in each of the heads 41 is equivalent.

Furthermore, in the above-described case, usage conditions are the same for nozzles at linkages between neighboring heads 41 (mainly the overlapping nozzles). Therefore, the raster lines corresponding to the linkage areas of the heads 41 are also formed having equivalent spacings (that is, formed regularly), and this results in enabling density irregularities originating in linkages to be suppressed.

Figure 11:
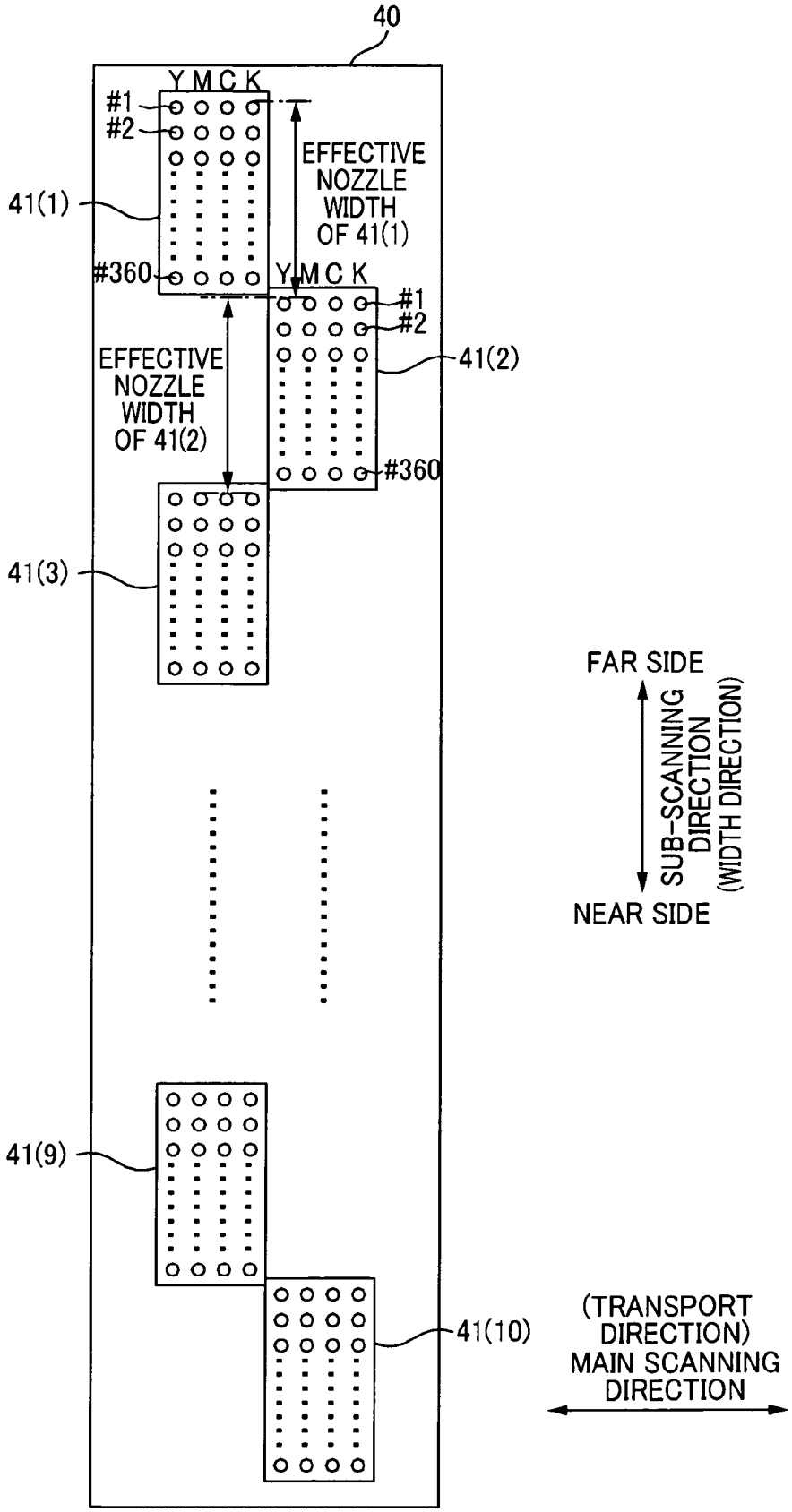
FIG. 11 shows a head unit 40 according to another embodiment.

Also, in the foregoing embodiments, the head unit 40 has overlapping nozzles (for example, the nozzle #15 of the head 41(1)), as shown in FIG. 4. However, there is no limitation to this. For example, as shown in FIG. 11, it is acceptable that the head unit 40 does not have an overlapping nozzle. In such a case, all nozzles (nozzle #1 to nozzle #360) of the nozzle rows of the respective heads 41 are effective nozzles. The effective nozzle width is the width for all the nozzles of the nozzle row. FIG. 11 shows a head unit 40 according to another embodiment.

What is claimed is:

1. A liquid ejecting apparatus comprising:

a head unit including a plurality of heads that extend in a first direction, the plurality of heads including a plurality of nozzles that eject a liquid onto a medium, are lined up in the first direction, and form a single raster line by ejecting the liquid while performing m number of movements relative to the medium in a second direction, wherein the second direction intersects the first direction, and a width of the head unit in the first direction is greater than a width of the medium in the first direction;

a movement mechanism that causes the head unit to perform a plurality of movements relative to the medium alternately in the second direction and the first direction; and a control section that forms an image having a resolution that is n times a pitch of the nozzles, by forming a plurality of the raster lines by the plurality of relative movements of the head unit, and that forms the image by setting a total movement amount of the head unit in the first direction when the head unit performs the plurality of relative movements, wherein the total movement is larger than an effective nozzle width of one of the heads in the first direction multiplied by (m×n−1), and smaller than the effective nozzle width x (m×n), and by setting respective movement amounts of the head unit in the first direction when the head unit performs the plurality of relative movements, larger than the effective nozzle width.

2. A liquid ejecting apparatus according to claim 1, wherein the respective movement amounts of the head unit in the first direction when the head unit performs the plurality of relative movements, are equal.

3. An image forming method comprising:

preparing a head unit that includes a plurality of heads that extend in a first direction, the plurality of heads including a plurality of nozzles that eject a liquid onto a medium, are lined up in the first direction, and form a single raster line by ejecting the liquid while performing m number of movements relative to the medium in a second direction, wherein the second direction intersecting the first direction and a width of the head unit in the first direction is greater than a width of the medium in the first direction; and forming an image having a resolution that is n times a pitch of the nozzles, by forming a plurality of the raster lines by causing the head unit to perform a plurality of movements relative to the medium alternately in the second direction and the first direction, by setting a total movement amount of the head unit in the first direction when the head unit performs the plurality of relative movements, wherein the total movement is larger than an effective nozzle width of one of the heads in the first direction multiplied by (m×n−1), and smaller than the effective nozzle width x (m×n), and by setting respective movement amounts of the head unit in the first direction when the head unit performs the plurality of relative movements, larger than the effective nozzle width.

* * * * *